US005222637A

United States Patent [19]

Giuffredi

[11] Patent Number: 5,222,637

[45] Date of Patent: Jun. 29, 1993

[54] MANUALLY OPERATED PUMP DEVICE FOR DISPENSING FLUIDS

[75] Inventor: Giancarlo Giuffredi, Milan, Italy

[73] Assignee: Coster Tecnologie Speciali S.p.A., Italy

[21] Appl. No.: 687,680

[22] Filed: Apr. 19, 1991

[30] Foreign Application Priority Data

Nov. 6, 1990 [IT] Italy ..... 21979 A/90

[51] Int. Cl.[5] ..... B67D 5/40

[52] U.S. Cl. ..... 222/336; 222/379; 222/380; 222/381; 222/383; 239/333

[58] Field of Search ..... 222/321, 336, 340, 341, 222/379, 380, 381, 382, 383; 239/333

[56] References Cited

U.S. PATENT DOCUMENTS

| | | | |
|---|---|---|---|
| 4,061,247 | 12/1977 | Meshberg | 222/341 X |
| 4,071,172 | 1/1978 | Balogh | 222/340 X |
| 4,161,288 | 7/1979 | McKinney | 239/333 |
| 4,169,546 | 10/1979 | Yuhas et al. | 222/341 |
| 4,247,048 | 1/1981 | Hayes | 239/333 X |
| 4,591,077 | 5/1986 | Corsette | 222/383 X |
| 4,606,480 | 8/1986 | Gazulla | 222/341 |
| 4,691,849 | 9/1987 | Tada | 222/383 X |
| 4,898,306 | 2/1990 | Tiramani | 222/340 |
| 4,953,791 | 9/1990 | Tada | 222/383 X |
| 4,971,227 | 11/1990 | Knickerbocker | 222/383 X |
| 4,982,900 | 1/1991 | Blake | 222/383 X |
| 5,050,779 | 9/1991 | Knickerbocker | 239/333 X |

FOREIGN PATENT DOCUMENTS

| | | | |
|---|---|---|---|
| 3001688 | 3/1981 | Fed. Rep. of Germany | 239/333 |
| 2143286 | 2/1985 | United Kingdom | 239/333 |

*Primary Examiner*—Kevin P. Shaver
*Attorney, Agent, or Firm*—Steinberg & Raskin

[57] ABSTRACT

A manually operated pump device for dispensing fluids from containers is disclosed. The pump device is provided with a mobile cylinder, a trigger lever for operating the cylinder, and a fixed piston located inside the cylinder. In the pump device, there is also a gasket and a stem-like member located inside a delivery and suction valve. The gasket and stem-like member act together to permit fluid to flow from the cylinder and to a delivery head during a delivery stage. During a sealing stage, the gasket and stem-like member operate in conjunction to seal the cylinder. A spring acts between the cylinder and the piston to allow fluid to flow again through the delivery valve.

14 Claims, 2 Drawing Sheets

MANUALLY OPERATED PUMP DEVICE FOR DISPENSING FLUIDS

BACKGROUND OF THE INVENTION

This invention relates to a manually operated pump device for dispensing fluids from containers, particularly of the portable type for connection to said containers, for example by threaded ring nuts or capsules.

Fluid dispensing pumps are known, consisting substantially of a trigger lever, a delivery channel and a handgrip containing in its interior a pumping system formed from a cylinder-piston assembly operationally connected to the lever, suction and delivery valves, and elastic return means.

The unidirectional valves provided in known pumps consist of shutoff valves of conventional type, for example of gravity or spring-loaded type.

Known pumps with a gravity valve on the delivery side operate properly only if used vertically or slightly inclined to their axis, otherwise the necessary force for their closure is not available. This is not the case with spring-loaded valves. However these latter also have drawbacks, in that during the suction stage, as the elastic force of the spring also has to be overcome a greater pressure difference is required between the pumping chamber and the container, which makes it very difficult to draw in dense liquids. In any event the use of springs increases the number of pump components and complicates their shape and assembly.

In addition, conventional pumps cannot be used with resinous or gluey liquids, in that if they dry in the pumping part they permanently block the pump.

Known pumps also generally drip annoyingly from the orifice of the delivery channel after operation.

Again in known pumps, it is not usual to provide a delivery head which enables the fluid to be delivered in different forms, for example in jet, spray, foam or atomized form.

SUMMARY OF THE INVENTION

The object of the invention is to provide a reliable manually operated pump device for dispensing fluids, which does not give rise to the aforesaid drawbacks, and in particular which can be used inclined at any angle to its axis or even inverted, and can also dispense highly viscous or gluey fluids, while being composed of only a small number of relatively simple components which can be obtained by moulding plastics material, and are easily assembled.

The pump according to the invention is characterised by comprising a mobile cylinder operationally connected to an operating trigger lever, a suction valve comprising a stem-like member and a valve seat at one end of said cylinder, said stem-like member being axially mobile within the cylinder and passing through an elastically deformable stationary gasket which during the delivery stage separates from the stem-like member to thus allow passage of the fluid, whereas during the suction stage it adheres to said member to provide a seal.

The invention will be more apparent from the detailed description of a preferred embodiment thereof given hereinafter by way of nonlimiting example with reference to the accompanying drawings.

DETAILED DESCRIPTION OF THE INVENTION

Figure 1:
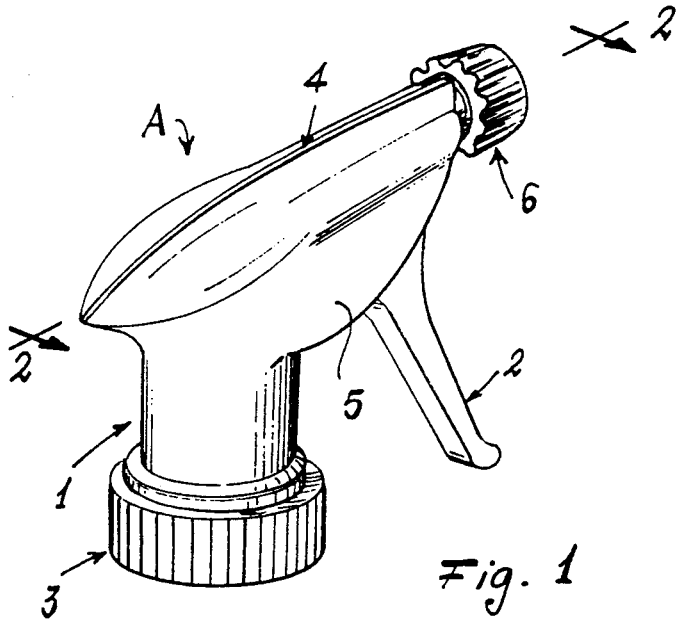
FIG. 1 is a perspective view of the pump device.

The pump device shown in FIG. 1 comprises a body A with a hollow cylindrical handgrip 1. The lower part of the handgrip 1 is connected to a screw cap 3 for connecting the device to the container containing the fluid to be delivered. The upper part is provided with a preferably diverging delivery channel 4 and two parallel spaced-apart shoulders 5 acting as lateral guides for a trigger lever 2.

The delivery channel 4 terminates with a delivery head 6 which is rotatable to allow adjustment of the shape of the emitted flow, as described hereinafter.

Figure 2:
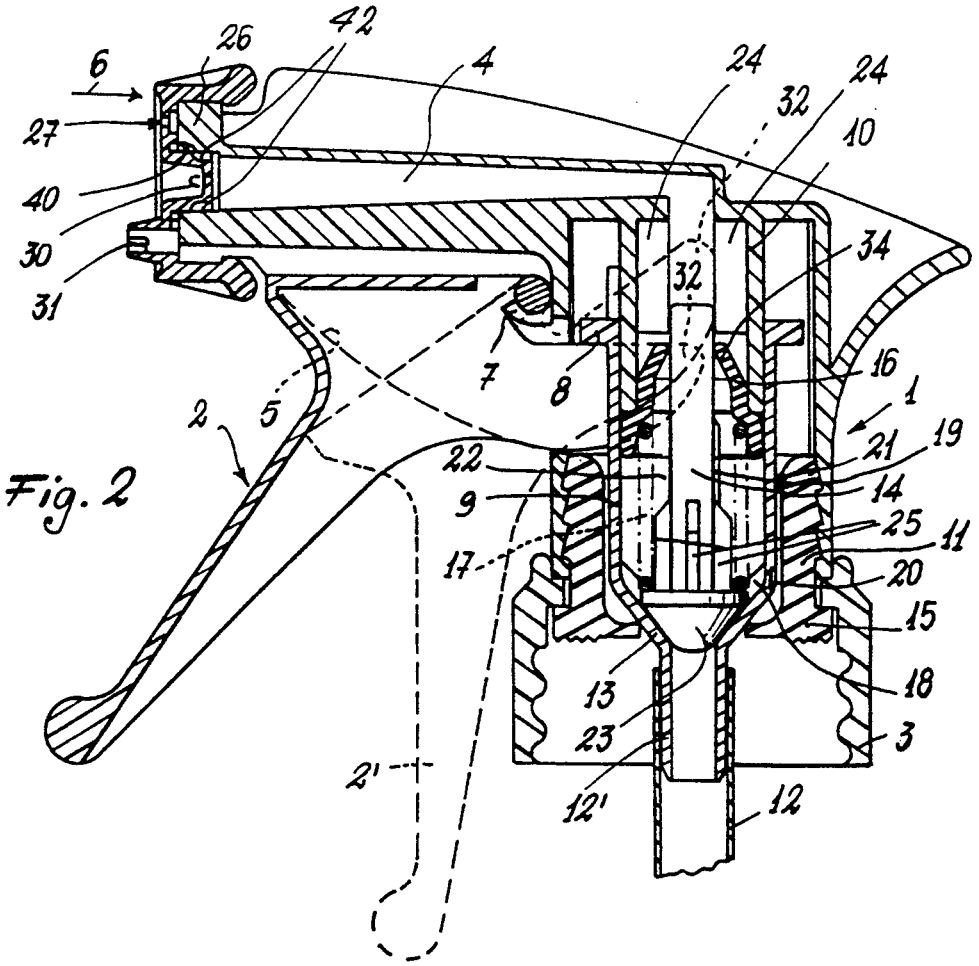
FIG. 2 is a section through the pump device ready for use, taken on the plane containing the axes 2—2.
Figure 3:
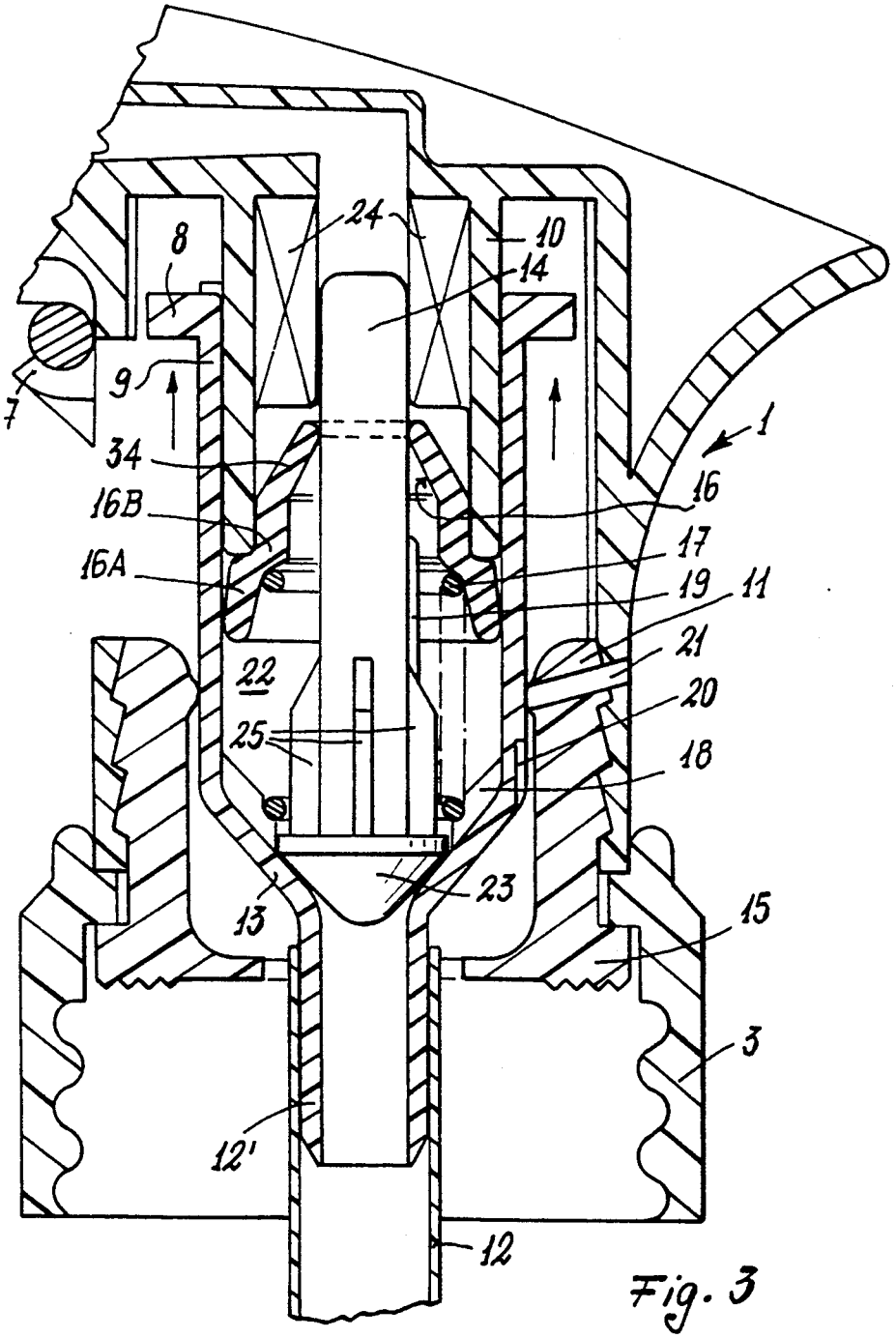
FIG. 3 is an enlarged section through a detail of the device as shown in FIG. 2, when the trigger lever has been partially operated.

With reference to FIGS. 2 and 3, the trigger lever 2 is pivoted on the supports 7 provided on the inner walls of the shoulders 5, and can move from the rest position 2 in which one end of the lever is in contact with the delivery channel, to the maximum operation position 2'. The trigger lever 2 also comprises two arms 32 which pass through a suitable aperture provided in the cylindrical wall of the handgrip 1 to cooperate with a collar 8 of a mobile cylinder 9 provided within said handgrip 1. The cylinder 9 slides along the walls of a fixed piston 10 and contracts lowerly into bottle-neck shape with a frusto-conical part 13 which when the trigger lever 2 is not operated rests on the lower collar of a ring 11. The end 12' of the neck engages with a dip-tube 12 which dips into the fluid to be dispensed. The outer wall of the cylinder 9 comprises an axial cavity 20 extending for a short distance prior to the bottle-neck. The ring 11 is shaped at one end in such a manner as to form a usual snap-fit with the handgrip 1, which is shaped correspondingly thereat. On the vertical line through the cavity 20 in the cylinder 9, the handgrip and ring 11 comprise a channel 21 connected to the outside. At its other end the ring 11 comprises a collar 15 which together with the terminal part of the handgrip 1 forms an annular recess in which the screw cap 3 engages.

Within the mobile cylinder 9 and piston 10, in a chamber defined by these latter, there are provided a stem-like member 14, a gasket 16 and a loading or return spring 17. The stem-like member 14 is arranged axially to the cylinder and has its bottom end 23 of frusto-conical shape with its base diameter greater than the rest of the member 14 and its inclination equal to the inclination of the frusto-conical part 13 of the mobile cylinder 9. Said stem-like member 14 also comprises a rib 19, and ribs 25 which extend for a certain distance from the base of the conical portion 23. Said stem-like member also passes through the gasket 16 to cooperate with ribs 24 which act as a guide and are positioned radially in the inner wall of the fixed piston 10 above said gasket 16. The gasket 16 is substantially of frusto-conical cap shape comprising a lower diverging toroidal band 16A in contact with the lateral walls of the mobile cylinder 9, a central step 16B externally in contact with the lower end of the fixed piston 10 and internally in contact with the end of the spring 17, and a conical terminal lip 34 which is thinner than the other portions and has its end in contact with the stem-like member 14. The toroidal band and the lip provide the seal against the cylinder 9 and against the stem-like member 14 respectively, during the operation of the pump. The spring 17 is retained upperly in the inner stepped part of the gasket 16 and lowerly in suitable ribs 18 provided within the conical part of the cylinder 9, but without acting directly on the conical portion 23 of the stem-like member 14. The delivery head 6 is snap-fitted to an annular portion 26 at the end of the variable-section delivery channel 4, and according to its position it either connects said channel 4, via a groove 42 and a fixed channel 40 in said annular portion 26, to one of the different-shaped orifices 31, 30 and 27, or prevents the fluid from leaving.

The operation is as follows.

On operating the trigger lever 2 the lever engages under the collar 8 of the mobile cylinder to raise it and, with the delivery head 6 set in the required position, allow the fluid to escape. More specifically, on operating the trigger lever 2 the cylinder 9 begins to rise but the conical part 13 of the cylinder acts on the conical portion 23 of the stem-like member 14 to hermetically seal the passage to the dip-tube 12. As the cylinder 9 continues to rise, the fluid present in the chamber 22 is compressed and on reaching a given pressure causes the lip 34 of the gasket 16 to diverge so that the fluid flows into the delivery channel 4 and from this through the delivery head to the outside. During this stage the discharge of any air bubbles present in the chamber 22 is facilitated by the rib 19 on the stem-like member 14 which, during the last part of the stroke, diverges the lip 34 to enlarge the passage channel and balance the pressure in the chamber 22 with the pressure of the external environment. At the end of the pumping stroke of the cylinder 9 one end of the cavity 20 reaches the opening of the channel 21 to balance the pressure between the fluid container and the outside. On releasing the trigger lever 2 the mobile cylinder 9, urged by the spring 17, moves downwards whereas the stem-like member 14 is retained by friction by the lip 34 of the gasket 16. The conical part 23 of said stem-like member separates from the conical restriction 13 of the cylinder 14 to thus open a passageway through which the fluid present in the suction channel 12 is drawn in. The passageway which is created has however only a small section because, as can be seen from FIG. 3, the conical part 23 can only rise through a small distance, as said part 23 is restricted in its upward movement by the turns of the spring 17. During its downward stroke, the stem-like member 14 sucks fluid back from the delivery channel 4, so preventing any possibility of dripping from the orifices of the delivery head 6. At the end of its stroke the member halts and seals against the conical restriction 13 of the cylinder 9.

What I claim is:

1. A manually operated pump device for dispensing fluids from a container comprising a mobile cylinder for receiving and retaining a fluid and passing the fluid therethrough, the fluid being received from a fluid-containing container attached to said pump device, a fixed piston located within said cylinder, said piston having an outer wall, said cylinder sliding along said outer wall of said piston, delivery means having two ends for receiving and dispensing fluid from said cylinder, said delivery means being connected at one of its ends to said cylinder and said delivery means dispensing fluid at an opposite one of its ends, a trigger lever connected to and for moving said cylinder, said trigger lever being operable between a first position to a second position for causing fluid to flow through said cylinder to said delivery means and movable from said second position back to said first position wherein fluid flow through said cylinder to said delivery means does not occur, a delivery and suction valve located within said cylinder, said valve comprising a gasket and a movable stem-like member having two ends passing through said gasket, said stem-like member contacts said gasket at one of its ends and a bottom portion of said cylinder at an opposite one of its ends, said gasket being separable from said stem-like member upon movement of said trigger lever to said second position from said first position such that upon separation of said gasket from said stem-like member, fluid flows from a top portion of said cylinder to said delivery means, said gasket being returnable into contact with said stem-like member upon return of said trigger lever to said first position such that upon return of said gasket into contact with said stem-like member, said top portion of said cylinder is sealed and fluid ceases to flow to said delivery means from said cylinder, and elastic return means located within said cylinder for returning the cylinder and thus the trigger lever from said second position to said first position, said stem-like member separating from said bottom portion of said cylinder upon return of said trigger lever to said first position because of suction within the cylinder such that a gap is created between said stem-like member and said bottom portion of said cylinder through which fluid from the container is sucked into said cylinder.

2. The device of claim 1, wherein said gasket contacts an inner wall of said cylinder to provide a tight seal.

3. The device of claim 1, wherein said gasket engages and exerts a braking action on said stem-like member when fluid stops flowing from said cylinder and between said stem-like member and said gasket.

4. The device of claim 1, wherein said stem-like member abuts against said piston.

5. The device of claim 1, wherein said bottom portion of said cylinder has a bottle-neck shape.

6. The device of claim 1, wherein said opposite one of its ends of said stem-like member has a conical shape.

7. The device of claim 1, wherein said elastic return means comprise a spring.

8. The device of claim 1, wherein said gasket has an inner stepped portion, and an inner wall of said cylinder comprises ribs, said elastic return means being retained by said ribs of said cylinder and by said inner stepped portion of said gasket.

9. The device of claim 1, wherein said cylinder has an outer wall, said cylinder having a cavity in the outer wall which is connectable to a channel disposed in a ring which slidably supports the cylinder.

10. The device of claim 1, wherein said stem-like member has a lower cylindrical portion, said cylindrical portion having a plurality of ribs which engage and open said gasket when said trigger lever is moved to said second position.

11. The device of claim 1, wherein said stem-like member is movable through a central opening of said gasket upon movement of said trigger lever, said stem-like member suctioning fluid present in a delivery channel in said delivery means during a return movement of said stem-like member corresponding to a return movement of said trigger lever from said second position to said first position.

12. The device of claim 11, further comprising a delivery head for dispensing fluid located at an end of said delivery channel, said stem-like member suctioning fluid in said delivery head during its return movement.

13. The device of claim 1, wherein a delivery head is located at the end of a delivery channel located in said delivery valve.

14. The device of claim 13, wherein said delivery head comprises a rotatable closure having a safety closure position and said closure includes means for dispensing fluid in different forms.

* * * * *